US012798752B2

(12) United States Patent
Iida et al.

(10) Patent No.: US 12,798,752 B2
(45) Date of Patent: Nov. 17, 2026

(54) OPERATION MODE SELECTION DEVICE, OPERATION MODE SELECTION ASSISTANCE DEVICE, SHIP, OPERATION MODE SELECTION METHOD, AND PROGRAM

(71) Applicant: MITSUBISHI HEAVY INDUSTRIES, LTD., Tokyo (JP)

(72) Inventors: Ryo Iida, Tokyo (JP); Tomohiko Sanada, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 152 days.

(21) Appl. No.: 18/874,271

(22) PCT Filed: Feb. 8, 2023

(86) PCT No.: PCT/JP2023/004127
§ 371 (c)(1),
(2) Date: Dec. 12, 2024

(87) PCT Pub. No.: WO2023/243139
PCT Pub. Date: Dec. 21, 2023

(65) Prior Publication Data

US 2025/0376252 A1 Dec. 11, 2025

(30) Foreign Application Priority Data

Jun. 16, 2022 (JP) ..... 2022-097558

(51) Int. Cl.
*B63J 3/04* (2006.01)
*B63B 79/20* (2020.01)
*B63H 21/17* (2006.01)

(52) U.S. Cl.
CPC ..... *B63J 3/04* (2013.01); *B63B 79/20* (2020.01); *B63H 21/17* (2013.01); *B63J 2003/043* (2013.01)

(58) Field of Classification Search
CPC ..... B63J 3/04; B63J 2003/043; B63B 79/20; B63H 21/17
See application file for complete search history.

(56) References Cited

U.S. PATENT DOCUMENTS

2021/0047012 A1* 2/2021 Umemiya ..... B63B 79/20

FOREIGN PATENT DOCUMENTS

CN 112510701 A * 3/2021 ..... G06F 18/2411
JP 2000-080673 A 3/2000
(Continued)

OTHER PUBLICATIONS

International Search Report dated Apr. 11, 2023, issued in counterpart Application No. PCT/JP2023/004127, with English Translation. (6 pages).
(Continued)

*Primary Examiner* — Marc Q Jimenez
*Assistant Examiner* — Jovon E Hayes
(74) *Attorney, Agent, or Firm* — WHDA, LLP

(57) ABSTRACT

This operation mode selection device selects an operation mode of a ship power system including one or a plurality of generators and batteries, the operation mode is determined through at least the number of generators in operation, the selection of a generator to be operated, a load sharing ratio of the generator and a battery, the selection of charging and discharging of the battery, and the device comprises a reinforcement learning unit which selects the operation mode; and performing reinforcement learning on a software agent.

8 Claims, 14 Drawing Sheets

(56) References Cited

FOREIGN PATENT DOCUMENTS

| | | | | | |
|---|---|---|---|---|---|
| JP | 2020-193949 | A | | 12/2020 | |
| JP | 2021-030748 | A | | 3/2021 | |
| WO | WO-2020186271 | A1 | * | 9/2020 | ..... H02J 7/80 |
| WO | WO-2023243139 | A1 | * | 12/2023 | ..... B63H 21/17 |

OTHER PUBLICATIONS

Written Opinion dated Apr. 11, 2023, issued in counterpart Application No. PCT/JP2023/004127, with English Translation. (6 pages).

* cited by examiner

OPERATION MODE SELECTION DEVICE, OPERATION MODE SELECTION ASSISTANCE DEVICE, SHIP, OPERATION MODE SELECTION METHOD, AND PROGRAM

TECHNICAL FIELD

The present disclosure relates to an operation mode selection device, an operation mode selection assistance device, a ship, an operation mode selection method, and a program. Priority is claimed to Japanese Patent Application No. 2022-097558, filed Jun. 16, 2022, the contents of which are incorporated herein by reference.

BACKGROUND ART

PTLs 1 to 3 describe techniques for optimizing an operation plan and the like related to ship navigation using a machine learning model.

CITATION LIST

Patent Literature

[PTL 1] Japanese Unexamined Patent Application Publication No. 2000-80673

[PTL 2] Japanese Unexamined Patent Application Publication No. 2020-193949

[PTL 3] Japanese Unexamined Patent Application Publication No. 2021-30748

SUMMARY OF INVENTION

Technical Problem

However, PTLs 1 to 3 do not disclose a technique for optimizing an operation mode in a power system of a ship.

An object of the present disclosure is to provide an operation mode selection device, an operation mode selection assistance device, a ship, an operation mode selection method, and a program capable of appropriately selecting an operation mode in a power system of the ship.

Solution to Problem

In order to achieve the above object, the operation mode selection device according to the present disclosure is an operation mode selection device that selects an operation mode of a ship power system including one or a plurality of generators and one or a plurality of batteries, in which the operation mode is determined by at least the number of the generators in operation, selection of the generators to be operated, a load sharing ratio between the generators and the batteries, and selection of charging and discharging of the batteries, the operation mode selection device including: a reinforcement learning unit that selects the operation mode by performing reinforcement learning on a software agent, using an output of a model of the ship power system that operates based on a prescribed setting pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime, as a reward element.

The operation mode selection method according to the present disclosure is an operation mode selection method of selecting an operation mode of a ship power system including one or a plurality of generators and one or a plurality of batteries, in which the operation mode is determined by at least the number of the generators in operation, selection of the generators to be operated, a load sharing ratio between the generators and the batteries, and selection of charging and discharging of the batteries, the operation mode selection method including: a step of selecting the operation mode by performing reinforcement learning on a software agent, using an output of a model of the ship power system that operates based on a prescribed setting pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime, as a reward element.

The program according to the present disclosure is a program for selecting an operation mode of a ship power system including one or a plurality of generators and one or a plurality of batteries, in which the operation mode is determined by at least the number of the generators in operation, selection of the generators to be operated, a load sharing ratio between the generators and the batteries, and selection of charging and discharging of the batteries, the program for causing a computer to execute: a step of selecting the operation mode by performing reinforcement learning on a software agent, using an output of a model of the ship power system that operates based on a prescribed setting pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime, as a reward element.

Advantageous Effects of Invention

According to the operation mode selection device, the operation mode selection assistance device, the ship, the operation mode selection method, and the program of the present disclosure, it is possible to appropriately select the operation mode in the power system of the ship.

DESCRIPTION OF EMBODIMENTS

Figure 1:
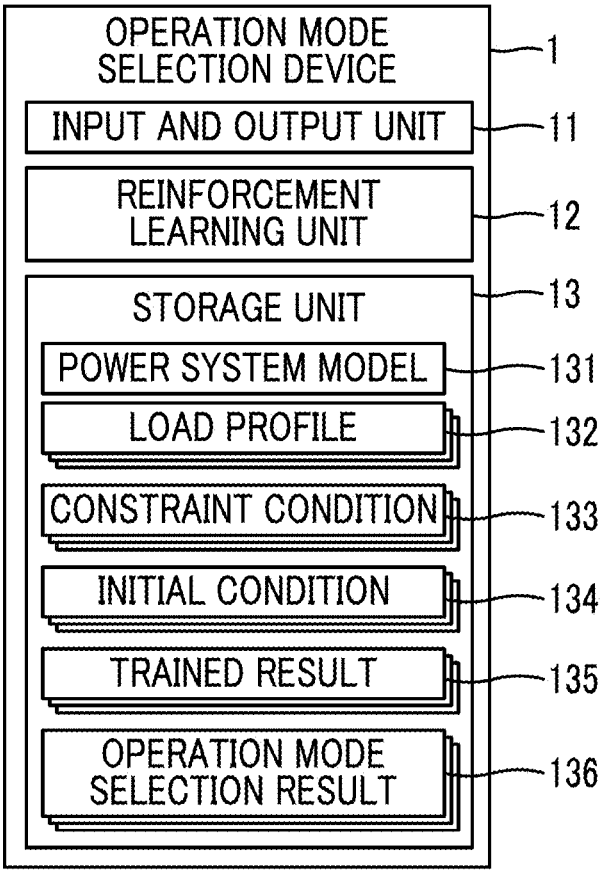
FIG. 1 is a block diagram showing a configuration example of an operation mode selection device according to an embodiment of the present disclosure.
Figure 2:
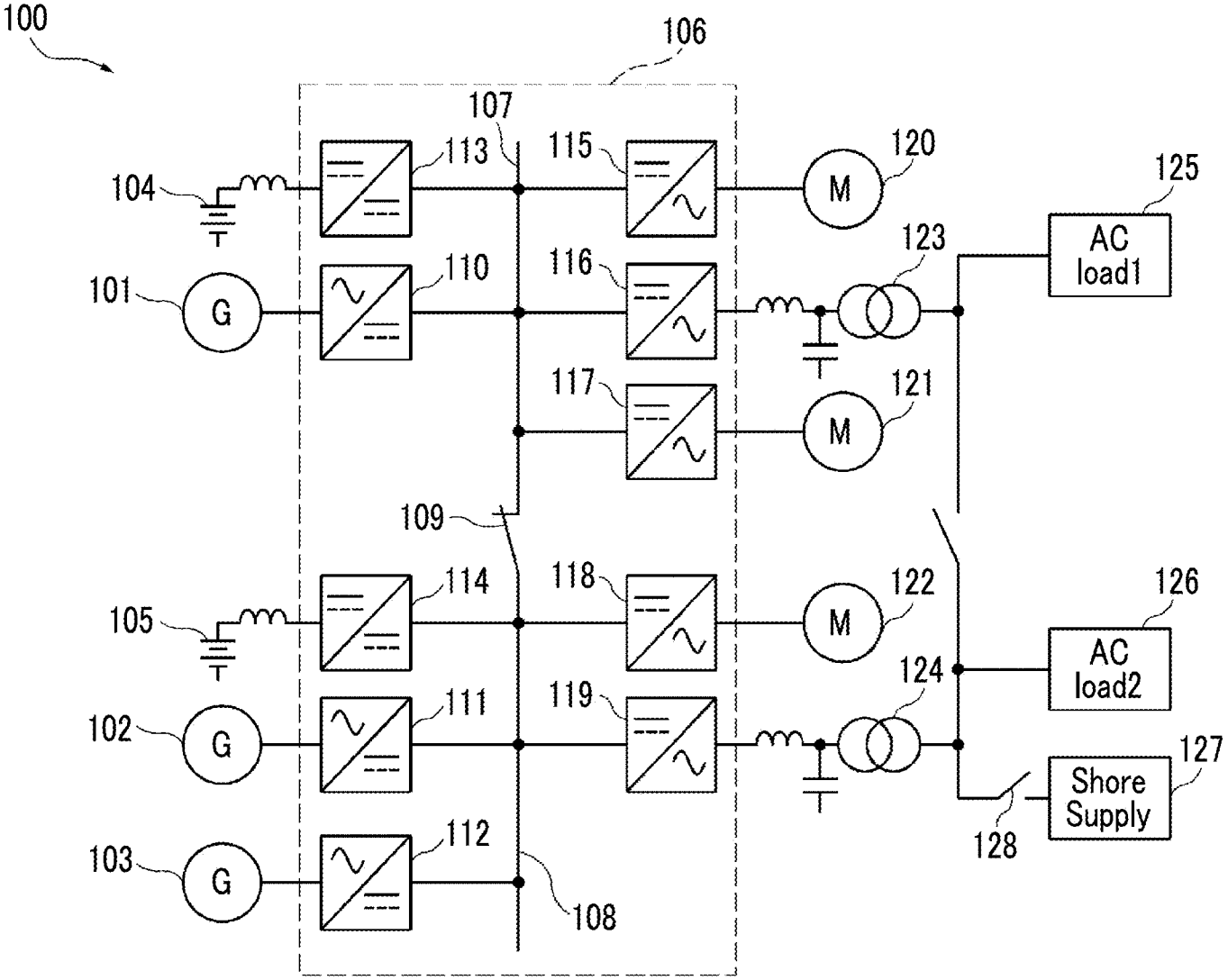
FIG. 2 is a block diagram showing a configuration example of a ship power system according to the embodiment of the present disclosure.
Figure 3:
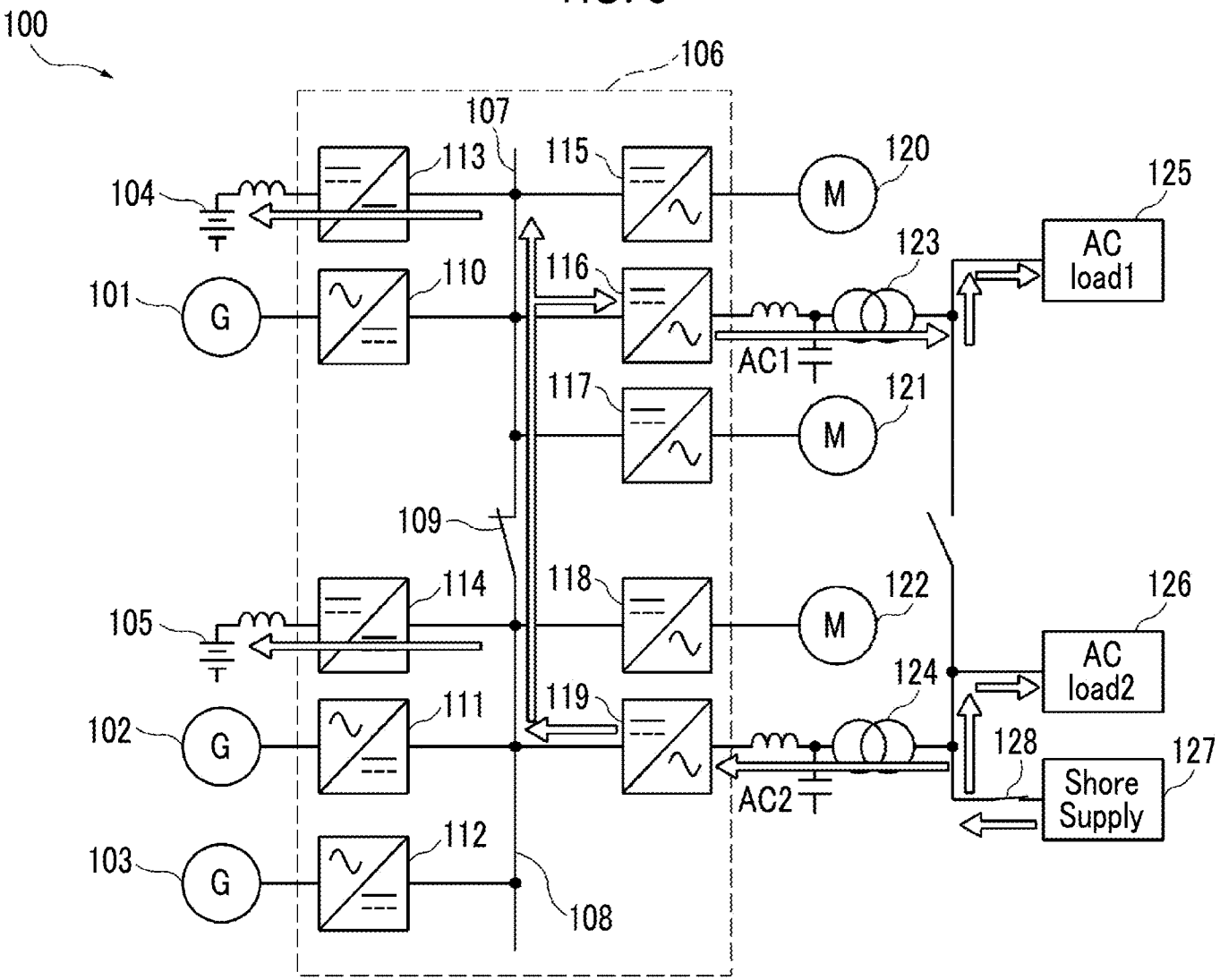
FIG. 3 is a diagram showing an example of an operation mode of the ship power system according to the embodiment of the present disclosure.
Figure 4:
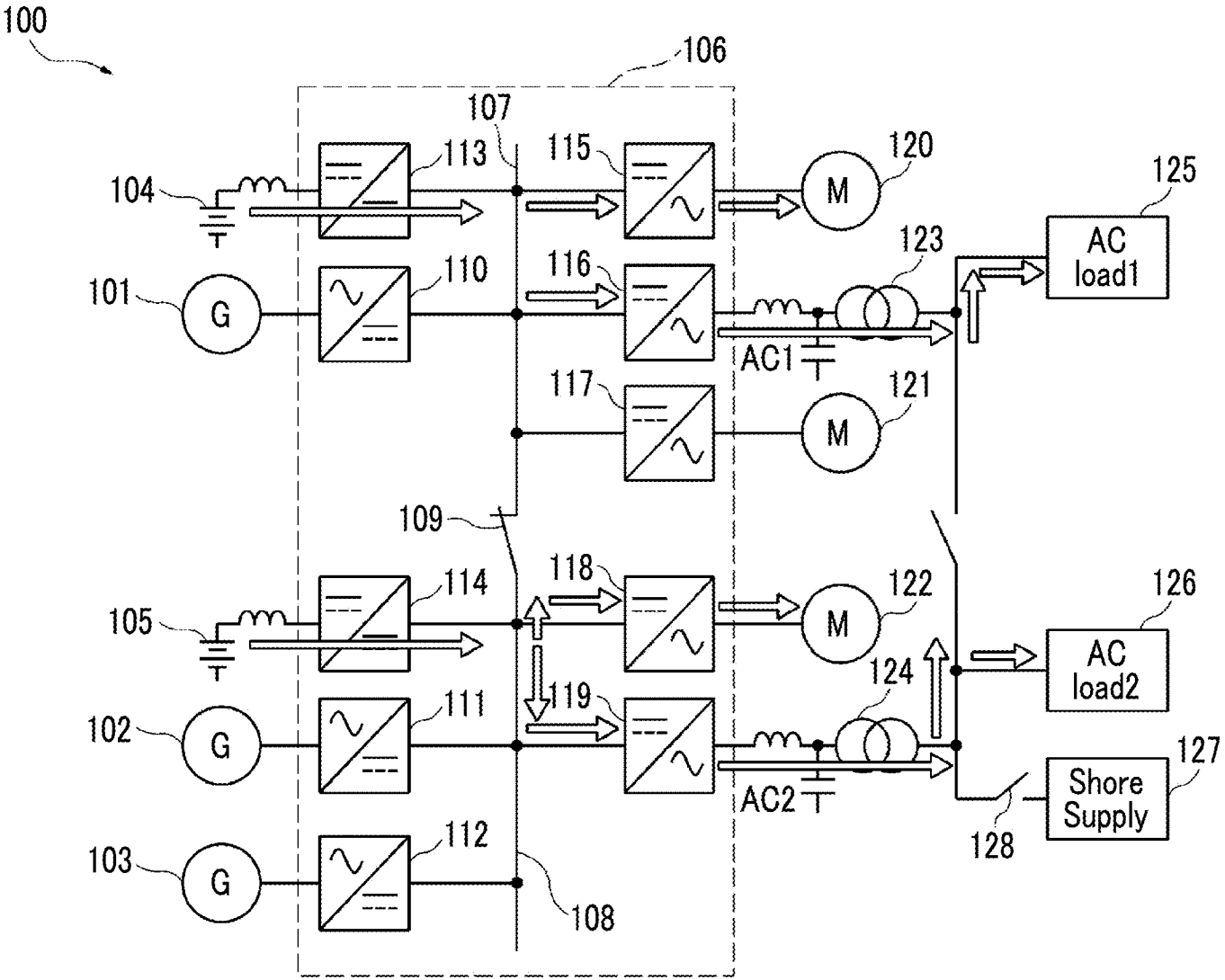
FIG. 4 is a diagram showing an example of the operation mode of the ship power system according to the embodiment of the present disclosure.
Figure 5:
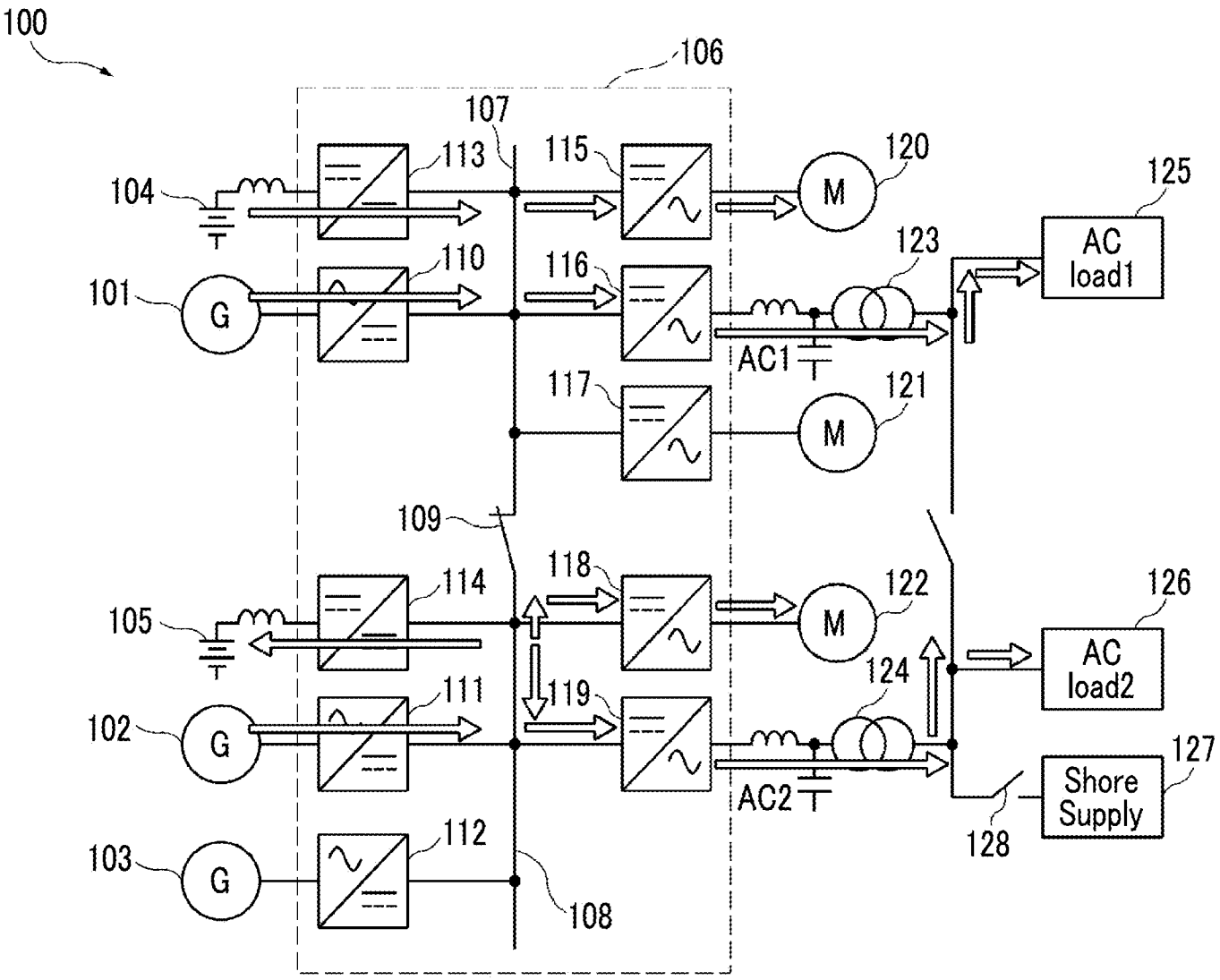
FIG. 5 is a diagram showing an example of the operation mode of the ship power system according to the embodiment of the present disclosure.
Figure 12:
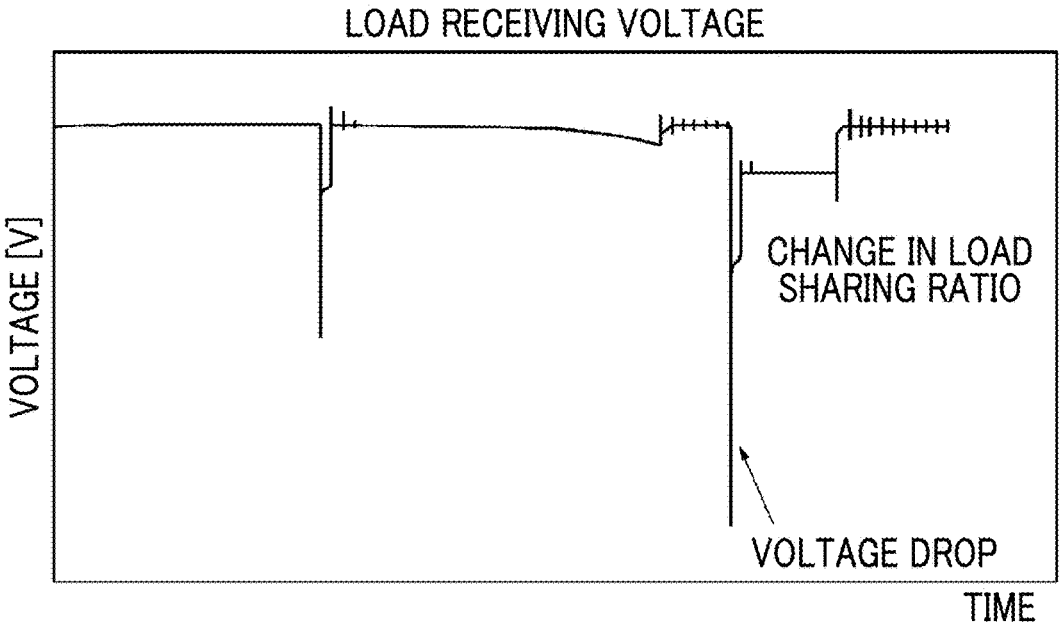
FIG. 12 is a schematic diagram for describing the reinforcement learning unit according to the embodiment of the present disclosure.
Figure 13:
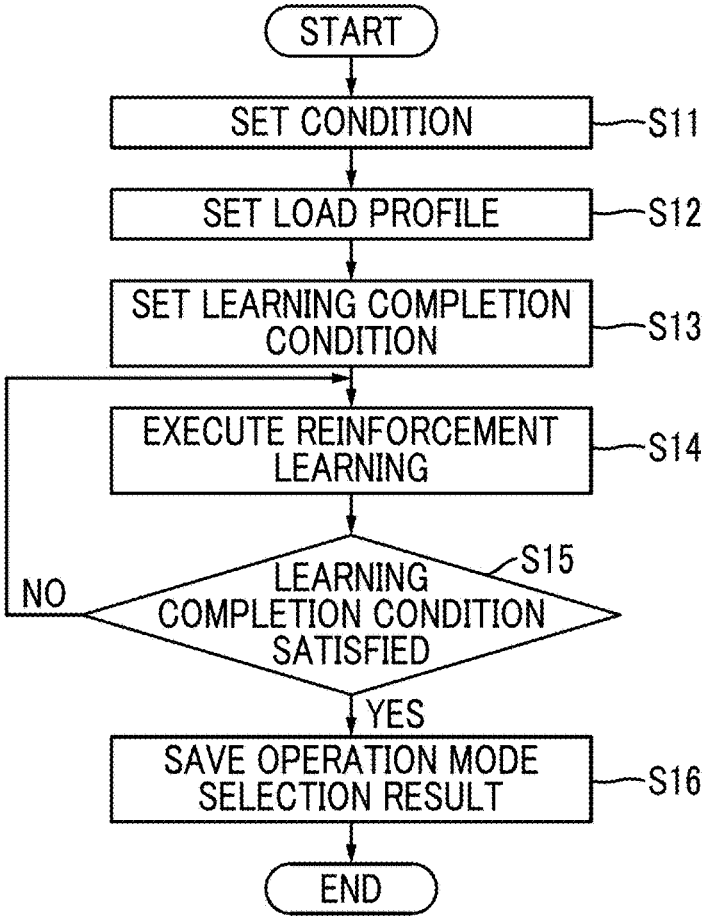
FIG. 13 is a flowchart showing an operation example of the operation mode selection device according to the embodiment of the present disclosure.
Figure 14:
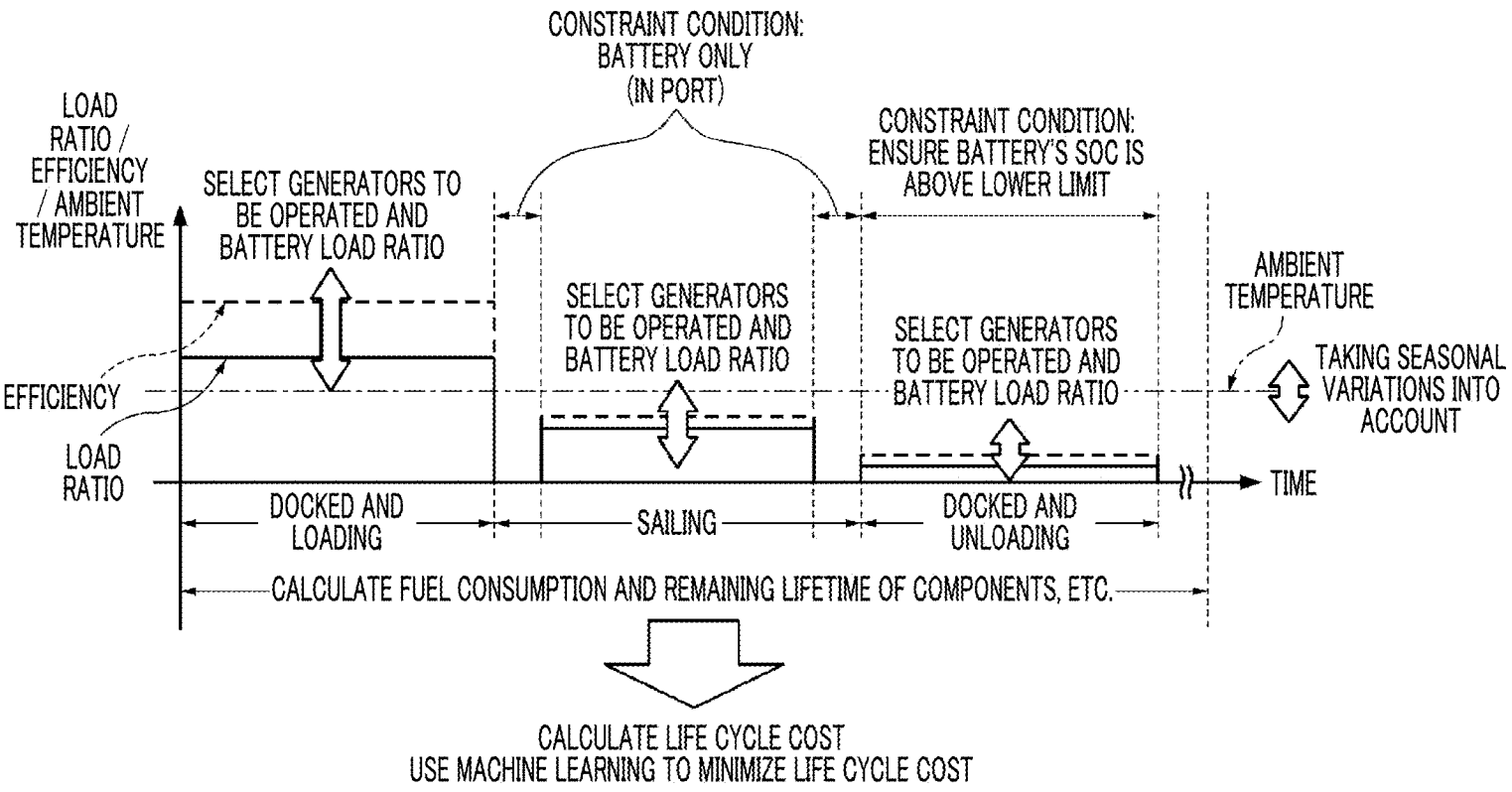
FIG. 14 is a schematic diagram for describing the reinforcement learning unit according to the embodiment of the present disclosure.
Figure 15:
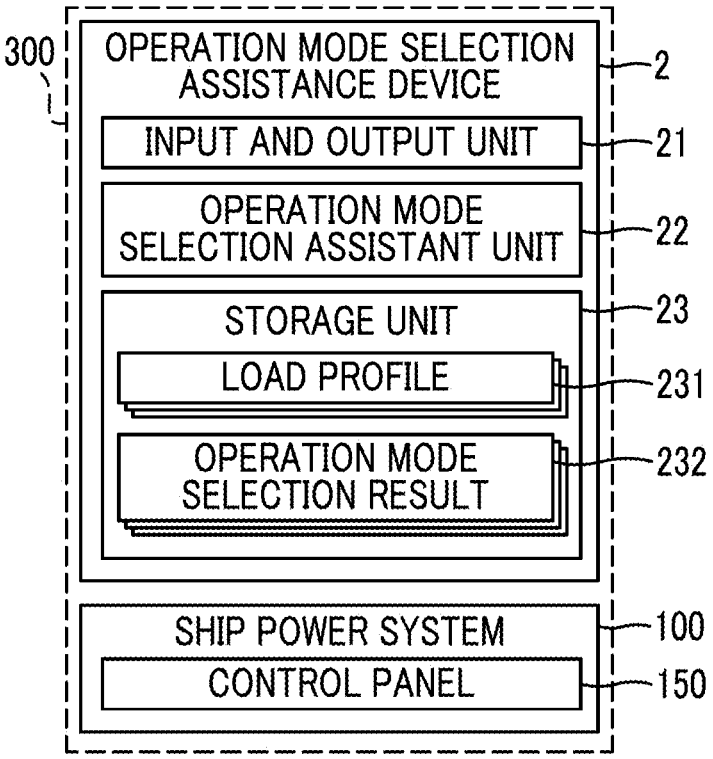
FIG. 15 is a block diagram showing a configuration example of an operation mode selection assistance device according to the embodiment of the present disclosure.
Figure 16:
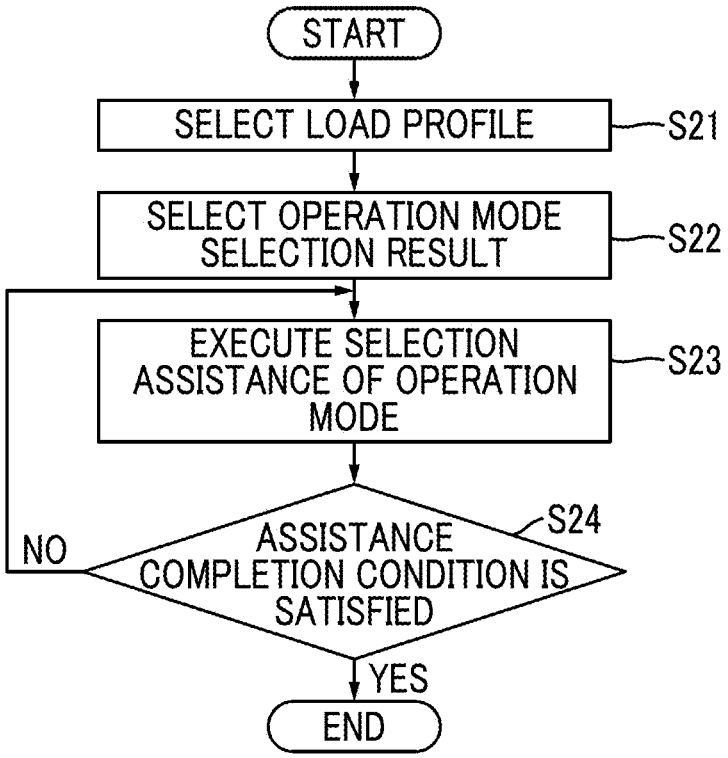
FIG. 16 is a flowchart showing an operation example of the operation mode selection assistance device according to the embodiment of the present disclosure.

Hereinafter, an operation mode selection device, an operation mode selection assistance device, a ship, an operation mode selection method, and a program according to an embodiment of the present disclosure will be described with reference to FIGS. 1 to 16. FIG. 1 is a block diagram showing a configuration example of an operation mode selection device according to an embodiment of the present disclosure. FIG. 2 is a block diagram showing a configuration example of a ship power system according to the embodiment of the present disclosure. FIGS. 3 to 5 are diagrams showing examples of operation modes of the ship power system according to the embodiment of the present disclosure. FIGS. 6 to 12 are schematic diagrams for describing the reinforcement learning unit according to the embodiment of the present disclosure. FIG. 13 is a flowchart showing an operation example of the operation mode selection device according to the embodiment of the present disclosure. FIG. 14 is a schematic diagram for describing the reinforcement learning unit according to the embodiment of the present disclosure. FIG. 15 is a block diagram showing a configuration example of an operation mode selection assistance device according to the embodiment of the present disclosure. FIG. 16 is a flowchart showing an operation example of the operation mode selection assistance device according to the embodiment of the present disclosure. In each drawing, the same reference numerals will be assigned to the same or corresponding configurations, and description thereof will be omitted as appropriate.

(Configuration of Operation Mode Selection Device (1))

FIG. 1 shows a configuration example of an operation mode selection device according to an embodiment of the present disclosure. An operation mode selection device 1 shown in FIG. 1 can be configured using, for example, one or a plurality of computers such as servers and peripheral devices of the computers. Some or all of one or the plurality of computers and peripheral devices may be configured on a cloud. The operation mode selection device 1 includes an input and output unit 11, a reinforcement learning unit 12, and a storage unit 13, as a functional configuration composed of a combination of hardware such as one or the plurality of computers and peripheral devices and software such as a program executed by the computer. In addition, the storage unit 13 stores a power system model 131 (a file containing data representing the power system model (the same applies below and will be omitted)), a load profile 132, a constraint condition 133, an initial condition 134, a trained result 135, and an operation mode selection result 136. The operation mode selection device 1 according to the present embodiment is a device that selects an operation mode of a ship power system 100 as shown in FIG. 2.

(Configuration and Operation Mode of Ship Power System)

First, the ship power system 100 shown in FIG. 2 will be described. The ship power system 100 shown in FIG. 2 is a power system installed on a ship, and includes generators 101, 102, and 103, batteries 104 and 105, and a DC hub 106. The DC hub 106 includes DC buses 107 and 108, a switch 109, AC-DC converters 110, 111, and 112, bidirectional DC-DC converters 113 and 114, and bidirectional DC-AC converters 115, 116, 117, 118, and 119. The generators 101 to 103 are diesel generators using a diesel engine as a prime mover. In the present embodiment, the DC power transmission and distribution system formed by the DC hub 106 is referred to as a DC (direct current) grid or a DC microgrid.

The AC-DC converters 110, 111, and 112 convert AC power generated by the generators 101, 102, and 103 into DC power and supply the DC power to the DC buses 107 or 108. The DC-DC converters 113 and 114 are connected to the DC bus 107 or 108, and control the charging and discharging power of batteries 104 or 105. The DC-AC converter 115 converts the DC power input from the DC bus 107 into AC power and drives a propulsion motor 120 of the ship. The DC-AC converter 116 converts the DC power input from the DC bus 107 into AC power and outputs the AC power to an AC load 125 via a transformer 123 or the like. The DC-AC converter 117 converts the DC power input from the DC bus 107 into AC power and drives a bow thruster motor 121 of the ship. The DC-AC converter 118 converts the DC power input from the DC bus 108 into AC power and drives a propulsion motor 122 of the ship. The DC-AC converter 119 converts the DC power input from the DC bus 108 into AC power and outputs the AC power to an AC load 126 via a transformer 124 or the like, or converts the AC power input from a shore power 127 via a switch 128, the transformer 124, or the like into the DC power and outputs the DC power to the DC bus 108.

In the present embodiment, the operation mode of the ship power system 100 is the operational state of the ship power system 100. The operation modes of the present embodiment include, for example, a mode in which all the generators 101 to 103 are operated, a mode in which some of the generators 101 to 103 are operated, and a mode in which none of the generators 101 to 103 are operated. In addition, the operation modes of the present embodiment include, for example, a mode in which both of the batteries 104 and 105 are discharged, a mode in which one of the batteries 104 and 105 is discharged, a mode in which both of the batteries 104 and 105 are charged, a mode in which one of the batteries 104 and 105 is charged, and a mode in which neither of the batteries 104 and 105 is charged or discharged. In addition, there are a plurality of operation modes by a combination of each mode of the generators 101 to 103 and each mode of the batteries 104 and 105. Further, the operation modes are made different by making the values of the generated power and the charging and discharging power equal or different for each of the generators 101 to 103 and the batteries 104 to 105.

Here, with reference to FIGS. 3 to 5, a shore power mode, a fully electric propulsion mode, and a hybrid mode will be described as examples of the operation mode. FIG. 3 shows an example of the shore power mode. FIG. 4 shows an example of the fully electric propulsion mode. FIG. 5 shows an example of the hybrid mode. In FIGS. 3 to 5, the flow of power is indicated by outlined arrows.

The shore power mode shown in FIG. 3 is an operation mode when the ship is at the dock. The AC power supplied from the shore power 127 is supplied to the AC load 126, converted into DC power by the DC-AC converter 119, and supplied to the DC bus 108 and the DC bus 107. The DC-DC converter 113 controls the voltage and current of the DC power input from the DC bus 107 to charge the battery 104. The DC-DC converter 114 controls the voltage and current of the DC power input from the DC bus 108 to charge the battery 105. The DC-AC converter 116 converts the DC power input from the DC bus 107 into AC power having a constant frequency and a constant voltage, and supplies the AC power to the AC load 125 via the transformer 123 or the like.

The fully electric propulsion mode shown in FIG. 4 is a mode in which the power consumed by the propulsion motors 120 and 122 and the AC loads 125 and 126 is covered solely by the discharged power from the batteries 104 and 105. The generators 101 to 103 are stopped. The discharged power from the batteries 104 and 105 is output to the DC buses 107 and 108 via the DC-DC converters 113 and 114. The DC-AC converter 115 converts the DC power input from the DC bus 107 into AC power and drives the propulsion motor 120 of the ship. The DC-AC converter 116 converts the DC power input from the DC bus 107 into AC power and outputs the AC power to the AC load 125 via the transformer 123 or the like. The DC-AC converter 118 converts the DC power input from the DC bus 108 into AC power and drives the propulsion motor 122 of the ship. The DC-AC converter 119 converts the DC power input from the DC bus 108 into AC power and outputs the AC power to the AC load 126 via the transformer 124 or the like.

The hybrid mode shown in FIG. 5 is an operation mode in which some or all of the generators 101 to 103 are operated, and part or both of the batteries 104 to 105 are operated in a charging or discharging state. In the example shown in FIG. 5, the generators 101 and 102 generate power, the battery 104 is being discharged, and the battery 105 is being charged. The operation of the DC-AC converters 115, 116, 118, and 119 is the same as in the example described with reference to FIG. 4.

In the present embodiment, the operation mode of the ship power system 100 is defined by at least the number of generators 101 to 103 in operation, the selection of the generators 101 to 103 to be operated, a load sharing ratio between the generators 101 to 103 and the batteries 104 and 105, and the selection of charging and discharging of the batteries 104 and 105. The operation mode of the ship power system 100 can be switched by controlling the operations of the AC-DC converters 110 to 112, the DC-DC converters 113 to 114, the DC-AC converters 115 to 119, and the switch 128, for example, through operation on a control panel (control panel 150 in FIG. 15).

(Configuration of Operation Mode Selection Device (2))

The input and output unit 11 shown in FIG. 1 uses a keyboard, a mouse, a touch panel, a display, an audio input and output device, a recording medium, a communication device, or the like to input files input by an operation from an operator or from another terminal or the like, or to output contents of inputs and outputs to the reinforcement learning unit 12, processing results, or the like. The input and output unit 11 inputs, for example, the power system model 131, the load profile 132, the constraint condition 133, the initial condition 134, and the like, and stores them in the storage unit 13. The contents of each file will be described later.

The reinforcement learning unit 12 selects an operation mode by performing reinforcement learning on a software agent, using an output of a model of the ship power system 100 that operates based on a prescribed setting pertaining to a load of the ship power system 100, as an environmental element, at least the number of generators 101 to 103 in operation, the selection of the generators 101 to 103 to be operated, a load sharing ratio between the generators 101 to 103 and the batteries 104 and 105, and the selection of charging and discharging of the batteries 104 and 105, as an action element, and a fuel cost and a lifecycle cost pertaining to a component lifetime, as a reward element. In the present embodiment, the "prescribed setting pertaining to a load of the ship power system 100" is the load profile 132. The load profile 132 includes, for example, a time series of the load of the ship power system 100 and a time series of the ambient temperature.

The reinforcement learning unit 12 performs the reinforcement learning on the software agent, by imposing a penalty in at least one of case where the voltages of the DC buses 107 and 108 of the ship power system 100 become unstable to a degree greater than a predetermined degree, or where the frequency of switching the operation mode is equal to or greater than a predetermined threshold value.

Figure 6:
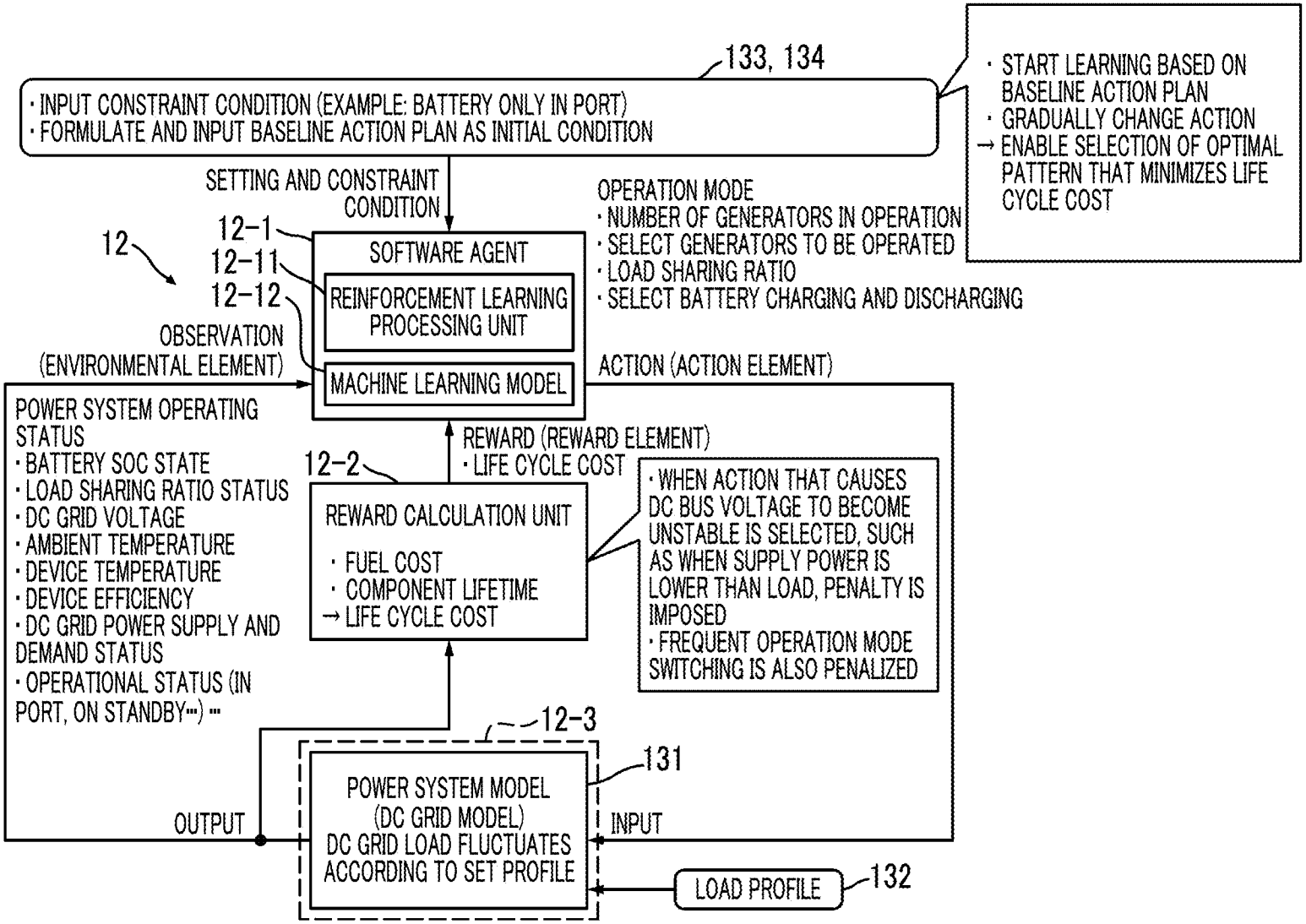
FIG. 6 is a schematic diagram for describing a reinforcement learning unit according to the embodiment of the present disclosure.

FIG. 6 shows an example of the configuration and operation of the reinforcement learning unit 12. The reinforcement learning unit 12 shown in FIG. 6 includes a software agent 12-1, a reward calculation unit 12-2, a control unit 12-3 that controls the power system model 131, a control unit (not shown) that controls start, end, and the like of reinforcement learning, and the like.

The software agent 12-1 includes a reinforcement learning processing unit 12-11 and a machine learning model 12-12. The machine learning model 12-12 is, for example, a machine learning model using a neural network, and inputs an environmental element observed by the software agent 12-1 and outputs the action element representing the action. The machine learning model 12-12 is machine-learned by the reinforcement learning processing unit 12-11 based on a predetermined reinforcement learning algorithm. The reinforcement learning algorithm is not limited, and any existing algorithm can be used. The reinforcement learning processing unit 12-11 inputs the environmental element that satisfies the constraint condition 133 and is observed by the software agent 12-1 to the machine learning model 12-12 based on the initial condition 134, and performs machine learning on the machine learning model 12-12 so that the action element that maximizes the reward is output. In the present embodiment, the action element is the element representing the action in reinforcement learning. The environmental element is the element observed in reinforcement learning. The reward element is the element representing the reward in reinforcement learning.

In the present embodiment, the action is the selection of an operation mode. The operation mode is represented by the number of generators in operation, the selection of generators to be operated, the load sharing ratio, and the selection of battery charging and discharging. In this case, the action elements are the number of generators in operation, the selection of generators to be operated, the load sharing ratio, and the selection of battery charging and discharging.

The operation mode may be further determined by selection of whether or not to supply power from the shore. In addition, the action elements may further include the selection of whether or not to supply power from the shore.

The reward is a lifecycle cost of the ship power system 100. The lifecycle cost is, for example, a total amount of a fuel cost required for a certain period such as a product lifetime, a design lifetime, or a planned usage period of the ship power system 100 and a cost other than the fuel cost such as a component replacement cost or an adjustment cost. The reward calculation unit 12-2 calculates the lifecycle cost based on the data indicating the operating status of the ship power system 100 output from the power system model 131 and the data indicating the characteristics of the lifetime of each device or component. In addition, for example, the reward calculation unit 12-2, by imposing a penalty in a case where the action that causes the DC bus voltage to become unstable is selected, such as when the supply power is lower than the load, or a case where the operation mode is frequently switched, notifies the software agent 12-1 that the operation mode determined to be a penalty is invalid, or adjusts the reward.

Figure 7:
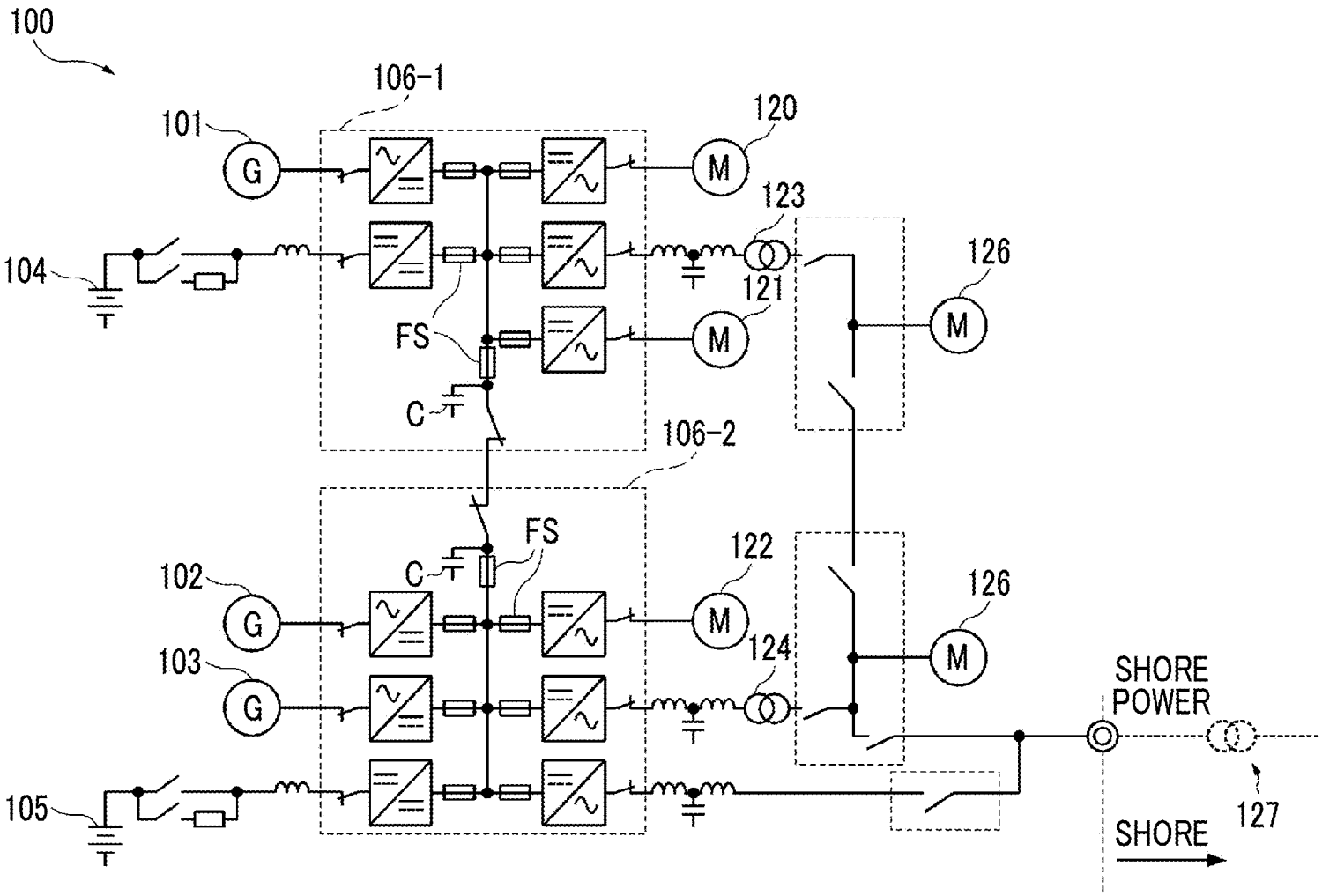
FIG. 7 is a schematic diagram for describing the reinforcement learning unit according to the embodiment of the present disclosure.
Figure 8:
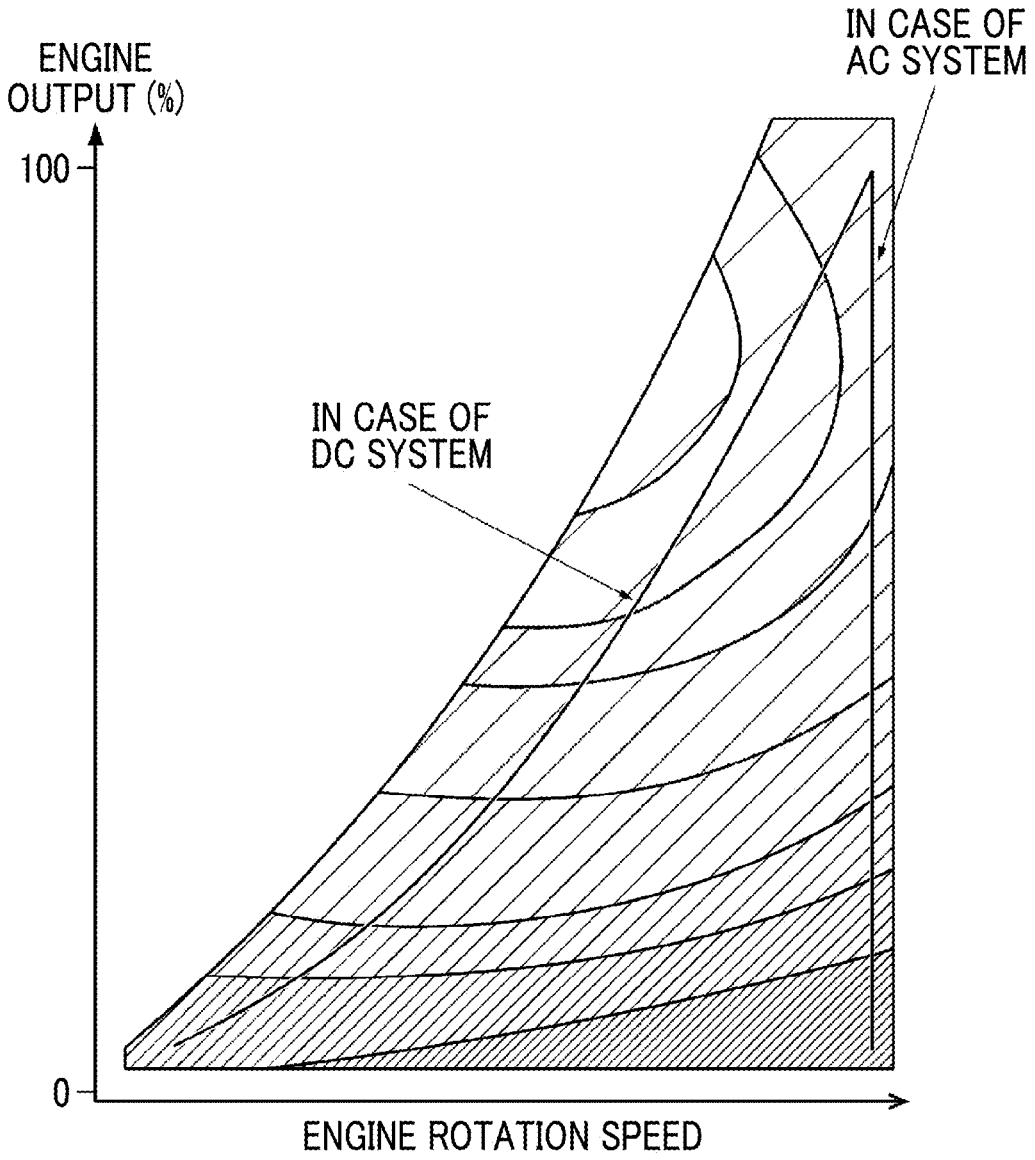
FIG. 8 is a schematic diagram for describing the reinforcement learning unit according to the embodiment of the present disclosure.
Figure 9:
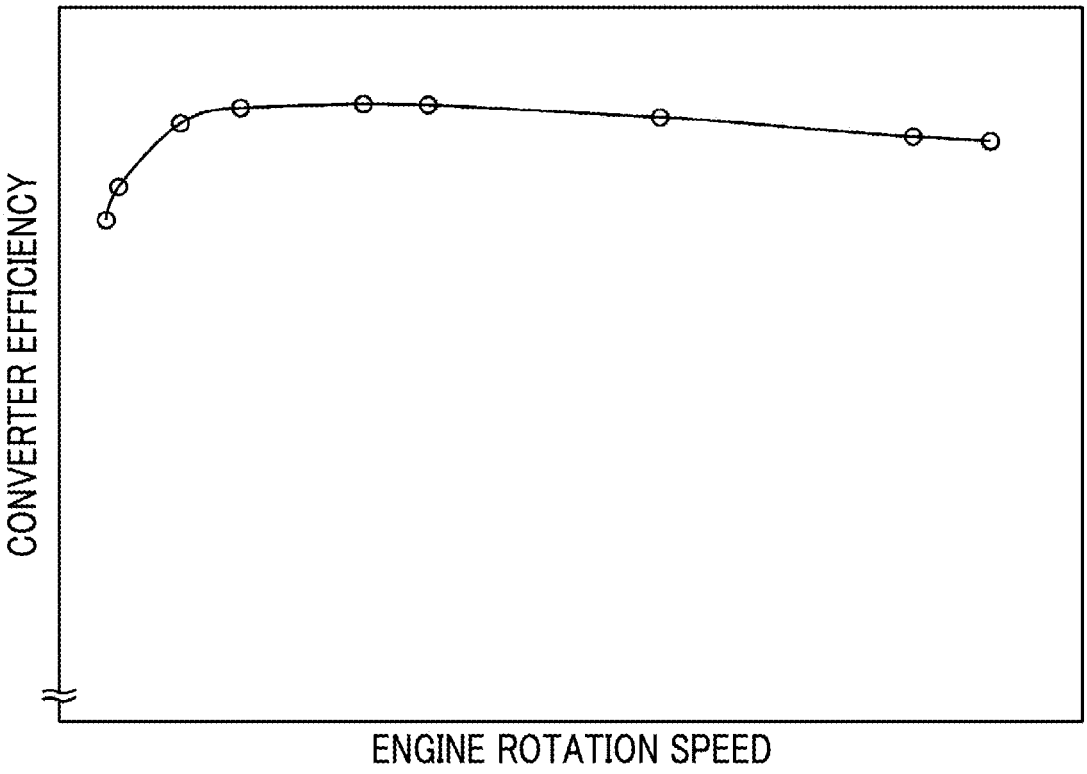
FIG. 9 is a schematic diagram for describing the reinforcement learning unit according to the embodiment of the present disclosure.
Figure 10:
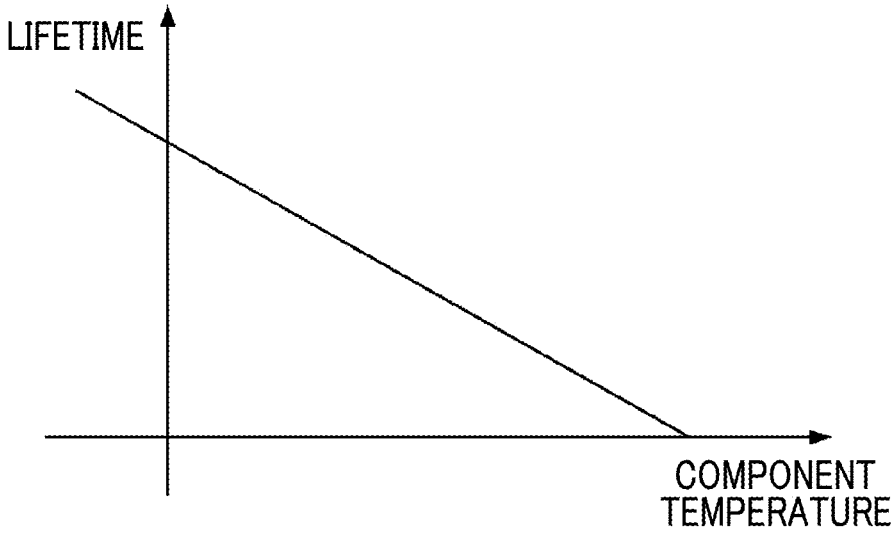
FIG. 10 is a schematic diagram for describing the reinforcement learning unit according to the embodiment of the present disclosure.

FIG. 7 shows an example of a replacement component targeted for lifetime calculation by the reward calculation unit 12-2. Examples of the replacement component include a fuse FS and a capacitor C. FIG. 8 shows an example of the efficiency of a diesel engine. The horizontal axis represents the engine rotation speed, and the vertical axis represents the engine output. The higher the density of the diagonal shading, the lower the efficiency. In the case of using a DC grid, as in the ship power system 100 of the present embodiment, the operation of the engine can be made to follow a curve-shaped characteristic, as shown for the DC system. Therefore, improvements in fuel efficiency and noise performance can be achieved as compared with the case of an AC system in which the rotation speed is constant. FIG. 9 shows an example of the characteristics of the conversion efficiency with respect to the output of the converter, such as DC-DC and DC-AC. FIG. 10 shows an example of the relationship between the component temperature and the lifetime. The power system model 131 includes a file representing the arrangement of each component in the system as shown in FIG. 7 and files representing the characteristics as shown in FIGS. 8 to 10. The power system model 131 calculates the efficiency by referring to these files. In addition, the reward calculation unit 12-2 calculates the lifetime of each device and component based on characteristics related to lifetime and factors such as ambient temperature.

Figure 11:
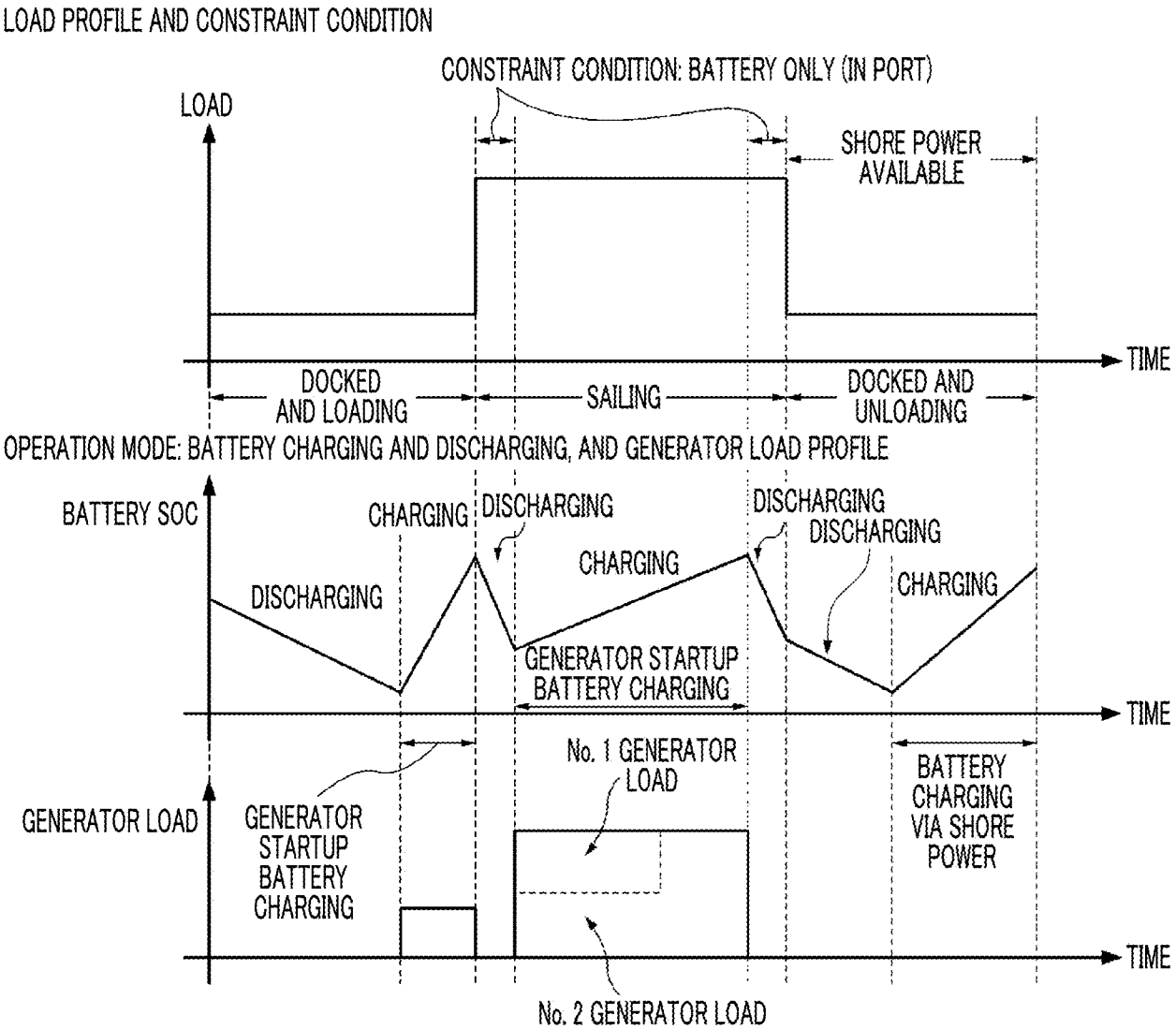
FIG. 11 is a schematic diagram for describing the reinforcement learning unit according to the embodiment of the present disclosure.

In addition, the constraint condition 133 is, for example, a constraint that a generator is not operated and a motor is driven by a battery in order to reduce noise or the like in a port during sailing, as shown as a constraint condition in FIG. 11. Alternatively, the constraint condition 133 is, for example, a constraint that a battery SOC (State of Charge; Charging rate) is equal to or higher than a lower limit value. The initial condition 134 is a setting condition for formulating a baseline action plan (a time series of action) and causing the software agent 12-1 to perform output in accordance with the action plan as initial values of the action elements. The software agent 12-1 starts learning based on the baseline action plan, gradually changes the action, and executes reinforcement learning so that an optimal pattern that minimizes the lifecycle cost can be selected in a short time.

FIG. 11 shows an example of the load profile 132, an example of the operation mode output by the software agent 12-1, and an example of data indicating the operating status output by the power system model 131. The load profile 132 represents a time series of a load (a motor, another AC load, or the like) of the ship power system 100. The operation mode output by the software agent 12-1 is a time series of the number of generators in operation, the selection of generators to be operated, a load sharing ratio, and the selection of battery charging and discharging. The data indicating the operating status output by the power system model 131 is a time series of the battery SOC and the load of each generator. In FIG. 11, the horizontal axis is a time axis. The vertical axis represents the load of the ship power system 100, the SOC of each battery, and the load (output) of the generator. In the example shown in FIG. 11, in the load profile 132, the load is low during the time when the ship is docked and loads. In addition, the load during sailing is greater than the load during docking. In addition, the load is low during the time when the ship is docked and unloads. The software agent 12-1 selects an operation mode that satisfies the constraint condition and minimizes the penalty with respect to the load profile 132. In this case, an operation mode is selected in which the battery is charged before sailing, and in the port, the battery is discharged and the generator is stopped. The software agent 12-1 selects a time series of the operation mode that minimizes the lifecycle cost through reinforcement learning over a long-term time series of the load profile 132 as shown in FIG. 11. For example, in the case of the ship power system 100, the lifecycle cost can be minimized in units of several decades. In this case, the No. 2 generator load increases in the latter half of the sailing so that the load ratio when operating two generators minimizes the lifecycle cost.

In the present embodiment, the power system model 131 is a simulation model that outputs environmental elements targeted for observation by the software agent 12-1. The power system model 131 is a model of the ship power system 100 that operates based on a prescribed setting (load profile 132) pertaining to the load of the ship power system 100 described above. The power system model 131 outputs the following elements (environmental elements) representing the operating status of the power system. That is, the power system model 131 outputs, for example, a battery SOC state, load sharing status, a device operating time, a DC grid voltage, an ambient temperature, a device temperature, device efficiency, DC grid power supply and demand status, operational status (in port, on standby, or the like), and the like as the environmental elements. FIG. 12 shows an example of the load receiving voltage output by the power system model 131. The horizontal axis represents time, and the vertical axis represents voltage. For example, as shown in FIG. 12, the power system model 131 outputs the results of calculations, such as voltage drop, changes in load sharing ratio.

(Operation Example of Operation Mode Selection Device)

FIG. 13 shows an operation example of the operation mode selection device 1. The processing shown in FIG. 13 is started, for example, in accordance with an instruction from an operator. In the processing shown in FIG. 13, first, the input and output unit 11 sets conditions such as a constraint condition and an initial condition in accordance with, for example, an operation by the operator, and stores the conditions in the storage unit 13 as the constraint condition 133 and the initial condition 134 (S11). Next, the input and output unit 11 sets a load profile, for example, in accordance with the operation by the operator, and stores the load profile in the storage unit 13 as the load profile 132 (S12). Next, the input and output unit 11 sets a learning completion condition, for example, in accordance with the operation by the operator (S13). For example, the learning completion condition can be set based on the magnitude of the reward, or can be set based on the processing time or the number of repetitions.

Next, the reinforcement learning unit 12 executes reinforcement learning (S14) while advancing or resetting the time stamp in the load profile 132, until the learning completion condition is satisfied (S15: YES). When the learning completion condition is satisfied (S15: YES), the reinforcement learning unit 12 stores the operation mode selection result in the storage unit 13 as the operation mode selection result 136 in association with the load profile 132, stores the content of the reinforcement learning such as the reward in the storage unit 13 as the trained result 135 (S16), and ends the processing shown in FIG. 13. FIG. 14 schematically shows an execution example of the reinforcement learning.

(Configuration of Operation Mode Selection Assistance Device)

FIG. 15 shows a configuration example of an operation mode selection assistance device according to an embodiment of the present disclosure. The operation mode selection assistance device 2 shown in FIG. 15 is installed on the ship 300 together with the ship power system 100. The ship power system 100 also includes a control panel 150. The operation mode selection assistance device 2 shown in FIG. 15 can be configured using, for example, one or a plurality of computers such as servers and peripheral devices of the computers. The operation mode selection assistance device 2 includes an input and output unit 21, an operation mode selection assistance unit 22, and a storage unit 23, as a functional configuration composed of a combination of hardware such as one or the plurality of computers and peripheral devices and software such as a program executed by the computer. The storage unit 23 stores a load profile 231 and an operation mode selection result 232.

The load profile 231 and the operation mode selection result 232 are the same as the load profile 132 and the operation mode selection result 136 shown in FIG. 1. The operation mode selection assistance unit 22 selects the load profile 231 (or the load profile 231 similar to the assumed load profile) assumed based on the scheduled or ongoing operation plan on the ship 300, for example, in accordance with the operation by the operator on the input and output unit 21. The operation mode selection assistance unit 22 selects the operation mode selection result 232 representing a time series of the operation mode selected by the reinforcement learning unit 12 with respect to the selected load profile 231, and outputs the content of the operation mode selection result 232 in a predetermined format at the input and output unit 21. The operator performs an operation on the control panel 150 based on the content of the output operation mode selection result 232.

(Operation Example of Operation Mode Selection Assistance Device)

FIG. 16 shows an operation example of the operation mode selection assistance device 2. The processing shown in FIG. 16 is started, for example, in accordance with an instruction from an operator. In the processing shown in FIG. 16, first, the input and output unit 21 selects the load profile 231, for example, in accordance with an operation by an operator (S21). Next, the operation mode selection assistance unit 22 selects the operation mode selection result 232 corresponding to the selected load profile 231 (S22). Next, the operation mode selection assistance unit 22 executes the selection assistance of the operation mode such as displaying the operation mode using the input and output unit 21 based on the operation mode selection result 232, until the assistance completion condition is satisfied (S24: YES) (S23). The assistance completion condition may be, for example, that the operator has performed a predetermined operation on the input and output unit 21. When the assistance completion condition is satisfied (S24: YES), the operation mode selection assistance unit 22 ends the processing shown in FIG. 16.

Operations and Effects

In a DC microgrid for a ship, there are various operation modes, and it is possible to select parameters such as charging and discharging of a battery, and a load sharing ratio between a generator and a battery. However, there are many parameters to be considered, such as fuel efficiency of a generator engine, SOC and lifetime of the battery, a load condition, and sailing status (before docking and after departure), making optimal mode selection difficult. On the other hand, according to the present embodiment, the reinforcement learning unit 12 is provided that selects an operation mode by performing reinforcement learning on a software agent, using an output of the power system model 131 that operates based on the load profile 132 of the ship power system 100, as an environmental element, at least the number of generators in operation, the selection of the generators to be operated, a load sharing ratio between the generators and the batteries, as an action element, and a fuel cost and a lifecycle cost pertaining to a component lifetime, as a reward element. Therefore, it is possible to appropriately select an operation mode in the power system of the ship.

Other Embodiments

Hereinabove, the embodiment of the present disclosure has been described in detail with reference to the drawings, but the specific configuration is not limited to the embodiment, and includes design changes and the like within a scope not departing from the gist of the present disclosure.

<Configuration of Computer>

Figure 17:
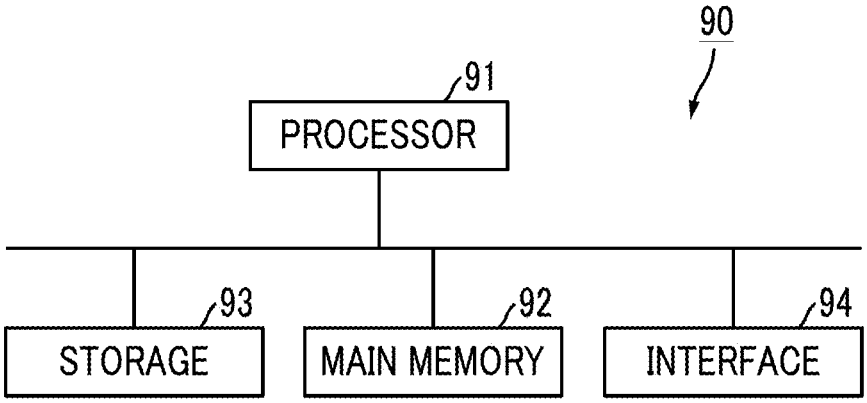
FIG. 17 is a schematic block diagram showing a configuration of a computer according to at least one embodiment.

FIG. 17 is a schematic block diagram showing a configuration of a computer according to at least one exemplary embodiment.

A computer 90 includes a processor 91, a main memory 92, a storage 93, and an interface 94.

The operation mode selection device 1 and the operation mode selection assistance device 2 described above are mounted on the computer 90. The operation of each processing unit described above is stored in the storage 93 in the form of a program. The processor 91 reads the program from the storage 93, develops the program in the main memory 92, and executes the above-described processing according to the program. In addition, the processor 91 secures a storage area corresponding to each storage unit described above in the main memory 92 according to the program.

The program may be for realizing some of the functions to be exhibited by the computer 90. For example, the program may exhibit a function in combination with another program already stored in a storage or in combination with another program implemented in another device. In another embodiment, the computer may include a custom large scale integrated (LSI) circuit such as a programmable logic device (PLD) in addition to or instead of the above configuration. Examples of the PLD include a programmable array logic (PAL), a generic array logic (GAL), a complex programmable logic device (CPLD), and a field programmable gate array (FPGA). In this case, some or all of the functions realized by the processor may be realized by the integrated circuit.

Examples of the storage 93 include a hard disk drive (HDD), a solid state drive (SSD), a magnetic disk, a magneto-optical disk, a compact disc read only memory (CD-ROM), a digital versatile disc read only memory (DVD-ROM), and a semiconductor memory. The storage 93 may be an internal medium directly connected to a bus of the computer 90, or may be an external medium connected to the computer 90 via the interface 94 or a communication line. In addition, when this program is distributed to the computer 90 via the communication line, the computer 90 that has received the distribution may develop the program in the main memory 92, and may execute the above-described processing. In at least one embodiment, the storage 93 is a non-transitory tangible storage medium.

<Additional Notes>

The operation mode selection device 1, the operation mode selection assistance device 2, the ship 300, the operation mode selection method, and the program according to each embodiment are understood as follows, for example.

(1) An operation mode selection device 1 according to a first aspect is an operation mode selection device that selects an operation mode of a ship power system 100 including one or a plurality of generators 101 to 103 and one or a plurality of batteries 104 and 105, in which the operation mode is determined by at least the number of the generators in operation, selection of the generators to be operated, a load sharing ratio between the generators and the batteries, and selection of charging and discharging of the batteries, the operation mode selection device including: a reinforcement learning unit 12 that selects the operation mode by performing reinforcement learning on a software agent 12-1 using an output of a model of the ship power system (power system model 131) that operates based on a prescribed setting (load profile 132) pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime; as a reward element. According to the present aspect and each of the following aspects, the operation mode of the power system of the ship can be appropriately selected.

(2) An operation mode selection device 1 according to a second aspect is the operation mode selection device according to (1), in which the reinforcement learning unit 12 performs the reinforcement learning on the software agent, by imposing a penalty in at least one of cases where a DC bus voltage of the ship power system becomes unstable to a degree greater than a predetermined degree, or where frequency of switching the operation mode is equal to or greater than a predetermined threshold value.

(3) An operation mode selection device 1 according to a third aspect is the operation mode selection device according to (1) or (2), in which the setting (load profile 132) includes information related to a load of the ship power system and information related to an ambient temperature.

(4) An operation mode selection device 1 according to a fourth aspect is the operation mode selection device according to any one of (1) to (3), in which the operation mode is further determined by selection of whether or not to supply power from shore, and the action element further includes selection of whether or not to supply power from shore.

(5) An operation mode selection assistance device 2 according to a fifth aspect includes an operation mode selection assistance unit 22 that assists in a selection operation of the operation mode based on the operation mode selected by the reinforcement learning unit 12 according to (1).

(6) A ship 300 according to a sixth aspect includes the operation mode selection assistance device 2 according to (5), and the ship power system 100.

(7) An operation mode selection method according to a seventh aspect is an operation mode selection method of selecting an operation mode of a ship power system including one or a plurality of generators and one or a plurality of batteries, in which the operation mode is determined by at least the number of the generators in operation, selection of the generators to be operated, a load sharing ratio between the generators and the batteries, and selection of charging and discharging of the batteries, the operation mode selection method including: a step of selecting the operation mode by performing reinforcement learning on a software agent, using an output of a model of the ship power system that operates based on a prescribed setting pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime, as a reward element.

(8) A program according to an eighth aspect is a program for selecting an operation mode of a ship power system including one or a plurality of generators and one or a plurality of batteries, in which the operation mode is determined by at least the number of the generators in operation, selection of the generators to be operated, a load sharing ratio between the generators and the batteries, and selection of charging and discharging of the batteries, the program for causing a computer to execute: a step of selecting the operation mode by performing reinforcement learning on a software agent, using an output of a model of the ship power system that operates based on a prescribed setting pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime, as a reward element.

INDUSTRIAL APPLICABILITY

According to the operation mode selection device, the operation mode selection assistance device, the ship, the operation mode selection method, and the program of the present disclosure, it is possible to appropriately select the operation mode in the power system of the ship.

REFERENCE SIGNS LIST

1: operation mode selection device
2: operation mode selection assistance device
12: reinforcement learning unit
12-1: software agent
22: operation mode selection assistance unit
131: power system model
132, 231: load profile
133, 232: operation mode selection result
100: ship power system
101 to 103: generator
104 and 105: battery
300: ship

The invention claimed is:

1. An operation mode selection device that selects an operation mode of a ship power system including one or a plurality of generators and one or a plurality of batteries, in which the operation mode is determined by at least the number of the generators in operation, selection of the generators to be operated, a load sharing ratio between the generators and the batteries, and selection of charging and discharging of the batteries, the operation mode selection device comprising:

a reinforcement learning unit that selects the operation mode by performing reinforcement learning on a software agent, using an output of a model of the ship power system that operates based on a prescribed setting pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime, as a reward element.

2. The operation mode selection device according to claim 1, wherein the reinforcement learning unit performs the reinforcement learning on the software agent, by imposing a penalty in at least one of cases where a DC bus voltage of the ship power system becomes unstable to a degree greater than a predetermined degree, or where frequency of switching the operation mode is equal to or greater than a predetermined threshold value.

3. The operation mode selection device according to claim 1 or 2, wherein the setting includes information related to the load of the ship power system and information related to an ambient temperature.

4. The operation mode selection device according to claim 3, wherein the operation mode is further determined by selection of whether or not to supply power from shore, and the action element further includes selection of whether or not to supply power from shore.

5. An operation mode selection assistance device comprising:

an operation mode selection assistance unit that assists in a selection operation of the operation mode based on the operation mode selected by the reinforcement learning unit according to claim 1.

6. A ship comprising:

the operation mode selection assistance device according to claim 5; and the ship power system.

7. An operation mode selection method of selecting an operation mode of a ship power system including one or a plurality of generators and one or a plurality of batteries, in which the operation mode is determined by at least the number of the generators in operation, selection of the generators to be operated, a load sharing ratio between the generators and the batteries, and selection of charging and discharging of the batteries, the operation mode selection method comprising:

a step of selecting the operation mode by performing reinforcement learning on a software agent, using an output of a model of the ship power system that operates based on a prescribed setting pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime, as a reward element.

8. A non-transitory computer-readable recording medium storing a program for selecting an operation mode of a ship power system including one or a plurality of generators and one or a plurality of batteries, in which the operation mode is determined by at least the number of the generators in operation, selection of the generators to be operated, a load sharing ratio between the generators and the batteries, and selection of charging and discharging of the batteries, the program for causing a computer to execute:

a step of selecting the operation mode by performing reinforcement learning on a software agent, using an output of a model of the ship power system that operates based on a prescribed setting pertaining to a load of the ship power system, as an environmental element, at least the number of the generators in operation, selection of the generators to be operated, a load sharing ratio between the generators and the batteries, and selection of charging and discharging of the batteries, as an action element, and a fuel cost and a lifecycle cost pertaining to a component lifetime, as a reward element.

* * * * *